US009664150B2

(12) United States Patent
Brand et al.

(10) Patent No.: US 9,664,150 B2
(45) Date of Patent: May 30, 2017

(54) FRESH AIR SYSTEM FOR AN INTERNAL COMBUSTION ENGINE

(71) Applicant: Mahle International GmbH, Stuttgart (DE)

(72) Inventors: Winfried Brand, Stuttgart (DE); Ivano Morgillo, Neuhuetten (DE)

(73) Assignee: Mahle International GmbH (DE)

( * ) Notice: Subject to any disclaimer, the term of this patent is extended or adjusted under 35 U.S.C. 154(b) by 255 days.

(21) Appl. No.: 14/540,019

(22) Filed: Nov. 12, 2014

(65) Prior Publication Data

US 2015/0128903 A1 May 14, 2015

(30) Foreign Application Priority Data

Nov. 13, 2013 (DE) ..... 10 2013 223 137

(51) Int. Cl.
*F02D 9/10* (2006.01)
*F02M 35/10* (2006.01)
*F02D 9/02* (2006.01)

(52) U.S. Cl.
CPC ..... *F02M 35/10006* (2013.01); *F02D 9/02* (2013.01); *F02D 9/1005* (2013.01); *F02D 9/1065* (2013.01); *F02D 9/1095* (2013.01); *F02M 35/10295* (2013.01); *F02M 35/10301* (2013.01); *F02D 9/1025* (2013.01); *F02D 2009/0269* (2013.01)

(58) Field of Classification Search
CPC ..... F02D 9/1065; F02D 11/107; F02M 35/10295; F02M 35/10301
USPC ..... 123/308, 336, 337, 397, 432
See application file for complete search history.

(56) References Cited

U.S. PATENT DOCUMENTS 3,821,941 A * 7/1974 Rychlik ..... F02B 25/00 123/306
4,261,304 A * 4/1981 Yamada ..... F02B 31/08 123/308
4,445,473 A * 5/1984 Matsumoto ..... F02B 31/06 123/308

(Continued)

FOREIGN PATENT DOCUMENTS

DE 2150166 A1 4/1972
DE 102004016912 A1 11/2005

(Continued)

OTHER PUBLICATIONS

English abstract for JP2002-349378.

(Continued)

*Primary Examiner* — Erick Solis
(74) *Attorney, Agent, or Firm* — Fishaman Stewart PLLC

(57) ABSTRACT

A fresh air system for supplying combustion chambers of an internal combustion engine with fresh air may include a housing, through which at least one fresh air path passes, and a flap mechanism, which includes at least one flap adjustably mounted on the housing. The flap may be rotatably adjustable between a closed position, in which the flap closes off the fresh air path in a fluid-tight manner and an opened position, in which the flap opens the fresh air path for fresh air to flow through. The flap mechanism may include a spring-elastic preload element, which supports itself on the housing and preloads the flap against at least one of the opened position and the closed position.

18 Claims, 3 Drawing Sheets

(56) References Cited

U.S. PATENT DOCUMENTS

| | | | | |
|---|---|---|---|---|
| 5,133,320 | A | 7/1992 | Kato et al. | |
| 5,181,491 | A | 1/1993 | Izumi et al. | |
| 5,907,971 | A * | 6/1999 | Sato | F02D 9/1065 74/25 |
| 6,129,071 | A * | 10/2000 | Pursifull | F02D 9/1015 123/337 |
| 6,973,913 | B2 | 12/2005 | Knorpp et al. | |
| 7,140,349 | B2 | 11/2006 | Hanasato | |
| 7,805,933 | B2 | 10/2010 | Hanitzsch et al. | |
| 2009/0101104 | A1 * | 4/2009 | Baasch | F02D 11/106 123/337 |
| 2009/0126356 | A1 | 5/2009 | Abram et al. | |

FOREIGN PATENT DOCUMENTS

| | | | |
|---|---|---|---|
| DE | 102004019980 | | 11/2005 |
| DE | 102006008346 | A1 | 8/2007 |
| EP | 1191210 | A1 | 3/2002 |
| EP | 2017510 | A1 | 1/2009 |
| EP | 2133538 | A1 | 12/2009 |
| GB | 1369049 | A | 10/1974 |
| JP | 2002-349378 | A | 12/2002 |
| JP | 2011-007089 | A | 1/2011 |

OTHER PUBLICATIONS

English abstract for JP2011-7089.
English Abstract for DE 102004019980.
English Abstract for EP 2017510.
English Abstract for EP 2133538.
Search Report for European Applcation No. EP 14191754.2, dated Feb. 13, 2015, 5 pp.

* cited by examiner

FRESH AIR SYSTEM FOR AN INTERNAL COMBUSTION ENGINE

CROSS-REFERENCE TO RELATED APPLICATIONS

This application claims priority to German Patent Application No. 10 2013 223 137.7, filed Nov. 13, 2013, the contents of which are hereby incorporated by reference in their entirety.

TECHNICAL FIELD

A fresh air system for internal combustion engines usually is to mean a device which serves for admitting fresh air into one or multiple combustion chambers of the internal combustion engine. In the case of a supercharged internal combustion engine, compression of the fresh air for example with the help of an exhaust gas turbocharger usually takes place within the fresh air system.

BACKGROUND

With respect to the effectiveness of the combustion processes taking place in the combustion chambers, adapting the air mass flow flowing through the fresh air system to a current rotational speed of the internal combustion engine, which in turn is determined by the frequency with which the process steps are cyclically carried out during the combustion in the combustion chamber, is of decisive importance. Modern fresh air systems are therefore often equipped with a flap mechanism, by means of which the line cross section of the fresh air path present in the fresh air system varies and thus the air mass flow rate that can flow through the fresh air path in a certain time interval can be adjusted.

However, problematic with such a flap mechanism often prove to be the vibration characteristics of the same, for the flap which is typically rigidly fastened to a pivot shaft is usually exposed to very high mechanical loads through the fresh air flowing through the fresh air path during the operation of the fresh air system. Since said pivot shaft is usually mounted only at the end side on a housing of the fresh air system, it is especially the combination of flap and pivot shaft that is susceptible to resonance-induced excitation of natural oscillations. Such oscillations can manifest themselves to the outside in the form of disturbing rattling or clattering noises, but always bring about increased wear of the components concerned in continuous operation.

SUMMARY

The present invention therefore sets itself the objective of creating a fresh air system in which the abovementioned disadvantages are partly or even completely eliminated and which is characterized in particular by improved wear resistance. The invention furthermore sets itself the objective of providing an internal combustion engine with such a fresh air system. Finally, the invention sets itself the objective of complementing a motor vehicle with such an internal combustion engine.

The mentioned objects are solved through the subject of the independent patent claims. Preferred embodiments are subject of the dependent patent claims.

The basic idea of the invention accordingly is to provide said flap mechanism with a spring-elastic preload element which supports itself on the housing and preloads the flap of the flap mechanism either against an opened or a closed position of the flap arranged in the fresh air path. Such a preload element generates a continuously active preload force onto the flap independently of the current flap position of the flap, so that the flap is automatically moved into the opened position or into the closed position without the action of any additional external force, such as can be actively generated for example by an actuator that is drive-connected to the pivot shaft of the flap mechanism, provided it has not already assumed this position anyhow. In the latter case, the preload force acting on the flap ensures an additional holding moment—in addition to the holding moment actively generated by an actuator during operation and acting on the flap—as a result of which the entire flap mechanism can be particularly effectively protected against undesirable natural oscillations including said "rattling" of the flap.

With suitable dimensioning of the spring-elastic characteristics of the preload element for example by suitably determining the value of the spring constant a principle of action known as "failsafe" function to the specific person skilled in the art can be additionally realised, with which in the case of a failure of the actuator the flap is automatically moved into the opened or closed position by the preload element—in the latter case against the fluid pressure generated by the fresh air—and fixed in the same as it were.

In a preferred embodiment, at least two, preferentially four, such fresh air paths are provided instead of only a single fresh air path. Typically, the number of the fresh air paths corresponds to the number of combustion chambers of the internal combustion engine, so that each fresh air path is assigned to exactly one combustion chamber. Distribution of the fresh air over the individual fresh air paths may be effected for example by means of a device known in the field of engine development as fresh gas distributor and can be directly integrated in the fresh air system. Corresponding to the number of fresh air paths, the requirement of providing a flap for the optional opening or closing of the individual fresh air paths also arises. The different flaps can altogether be mounted on a common pivot shaft which permits a simultaneous pivot adjustment of the individual flaps in the fluid paths. Typically, the fresh air paths in this case extend in the region of the flaps parallel to one another so that the pivot shaft can extend transversely to the individual fresh air paths.

Particularly advantageous in terms of production meanwhile proves to be an embodiment in which the spring-elastic preload element is formed as a leaf spring or coil spring. This allows mounting said leaf or coil spring for the desired preloading of the flap(s) in a simple manner with respect to assembly at one end—i.e. with a first end portion—on the housing of the fresh air system and on the other end—with a second end portion—on the pivot shaft or, alternatively to this, on the flap itself.

In order to keep the installation space required for fastening the preload element on the housing as small as possible it is advisable to form a support region designed pocket-like on the housing. On the housing walls of such a pocket, the first end portion of the leaf or coil spring can support itself.

Depending on the manner in which the preload element is arranged between pivot shaft or flap and housing, either a tension spring arrangement or a compression spring arrangement can materialise. In the case of the first mentioned arrangement the preload element, starting from a starting position, is transferred from said relaxed position into a tensioned state by rotating the pivot shaft. In the latter case, the pivot movement by contrast results in a compression of the preload element so that it is subjected to compressive press. In both mentioned cases, the preload force generated by the preload element and acting on the pivot shaft is increased. Depending on the installation situation in the fresh air system, a realisation as tension or compression spring arrangement can prove to be advantageous in terms of design. Designing the preload element as a coil spring proves to be particularly advantageous for use in a compression spring arrangement.

A mechanically stable fastening of the preload element designed as a leaf or coil spring can be achieved in that on the pivot shaft a recess that is designed complementarily to the second end portion of the leaf or coil spring is arranged, which is rotatably arranged on the pivot shaft with respect to the same. Such a recess may be provided for example directly in the pivot shaft or be directly moulded on in the flap. Alternatively to this it is also conceivable however to equip a separate holding element with such a recess and to fasten the holding element on the pivot shaft in a rotationally fixed manner or form said holding element integrally on said pivot shaft. Alternatively to this, such a holding element can also be fastened to the flap or be moulded onto the same. There are a wide range of options available to the person skilled in the art for permanently fixing the leaf spring in such a recess: conceivable for example is fastening by means of screwing, clipping in or injection overmoulding. Simple inserting of the second end portion into the recess is generally also conceivable.

In the event that the recess is not provided on the pivot shaft but on the flap, be it directly on the flap itself or on a holding element fastened to the flap or integrally moulded onto the same, it proves to be advantageous to provide the recess in a bearing region of the flap, in which the same or the pivot shaft is pivot-adjustably mounted on the housing.

A mechanically durable stable fastening of the leaf or coil spring requires providing a recess with adequate recess depth. Since however the depth of the recess that can be maximally realised in a pivot shaft or in a holding element with cylindrical design is limited, it is appropriate to equip the holding element with an extension projecting to the outside, in which the recess for receiving the leaf or coil spring can be provided.

In the case that the preload element is designed as a leaf spring it is recommended to form the first end portion of the leaf spring curved even in a state in which it is not yet mounted in the fresh air system, i.e. in the relaxed state. Such a quality of the leaf spring allows keeping the installation space required for the installation in the housing of the fresh air system small.

For the controlled movement of the pivot shaft and the at least one flap attached thereon the flap mechanism is preferably equipped with an actuator that is in particular electrically driven and drive-connected to the pivot shaft, by means of which actuator the flap can be pivot-adjusted between the opened and the closed position.

The invention furthermore relates to an internal combustion engine comprising at least one combustion chamber, which internal combustion engine is fluidically connected to a fresh air system with one or multiple features mentioned above. The invention furthermore relates to a motor vehicle with such a fresh air system.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

It shows, in each case schematically

DETAILED DESCRIPTION

Figure 1A:
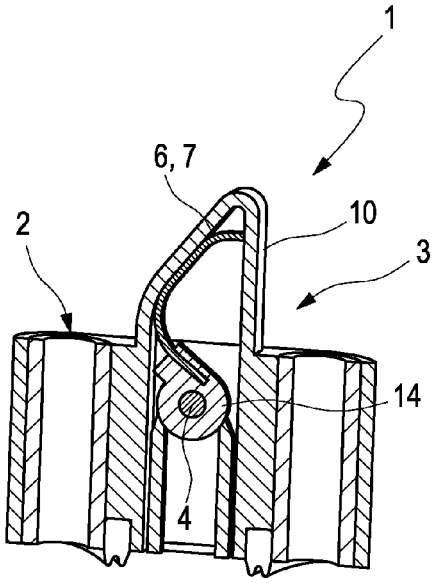
FIG. 1*a/b* part views each of a fresh air system according to the invention, FIG. 2 a flap mechanism of the fresh air system with four flaps, FIG. 3*a/b* examples of a preload element formed as a leaf spring, FIG. 4/5 the flap mechanism without/with a leaf spring mounted on the pivot shaft, in each case in a cross section, FIG. 6 a schematic representation of the flap mechanism as part of a tension spring arrangement, FIG. 7 a schematic representation of the flap mechanism as part of a compression spring arrangement.
Figure 1B:
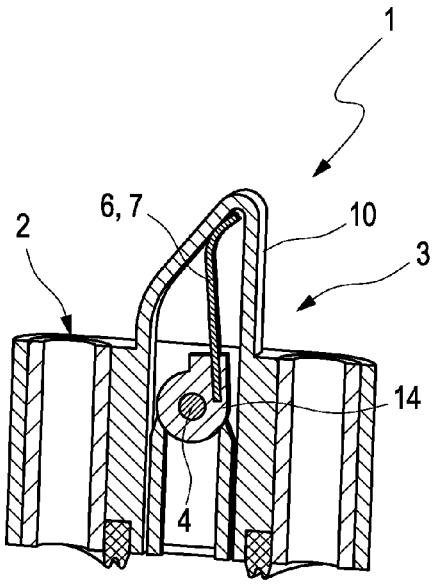
Figure 2:
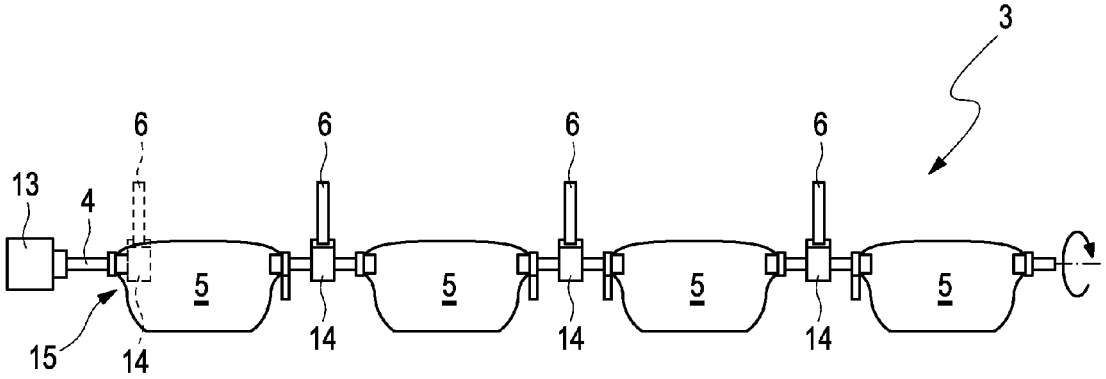

FIGS. 1*a* and 1*b* illustrate a part view of a fresh air system 1 according to the invention, which shows the flap mechanism 3 arranged in an adequately dimensioned housing 2 of the fresh air system 1. FIG. 2 shows said flap mechanism 3 in a separate representation. The same comprises in the example scenario of FIG. 2 four flaps 5 fastened on a common pivot shaft 4 in a rotationally fixed manner (the flaps 5 are not shown in the representation of FIGS. 1*a* and 1*b*).

The four flaps 5 are each arranged in a fresh air path (not shown) of the fresh air system 1, so that the four fresh air paths are closed off in a fluid-tight manner by the flaps 5 by rotating the pivot shaft 4, which is mounted on the housing 2 in a rotatably adjustable manner, into a closed position of the flaps 5. In an opened position by contrast the flaps 5 open the fresh air paths for fresh air to flow through so that it can be admitted into combustion chambers fluidically connected downstream of the fresh air system 1. Obviously, the flaps 5 can also be positioned in an intermediate position between said opened and closed position.

The flap mechanism 3 is now equipped with a spring-elastic preload element 6 in the form of a leaf spring 7 which supports itself on the housing 2, preloading the flaps 5 either against their opened or the closed position. FIG. 1*a* shows the leaf spring 7 in a position which is assigned to an opened position of the flaps 5, while FIG. 1*b* by contrast shows leaf spring 7 in a position which corresponds to closed position of the flaps 5.

Figure 3A:
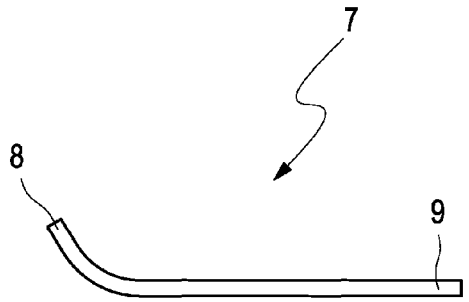
Figure 3B:
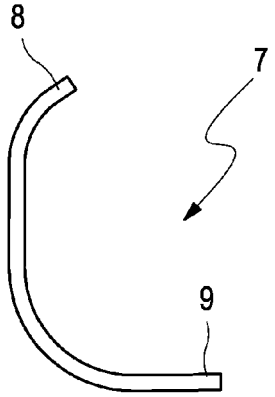
Figure 4:
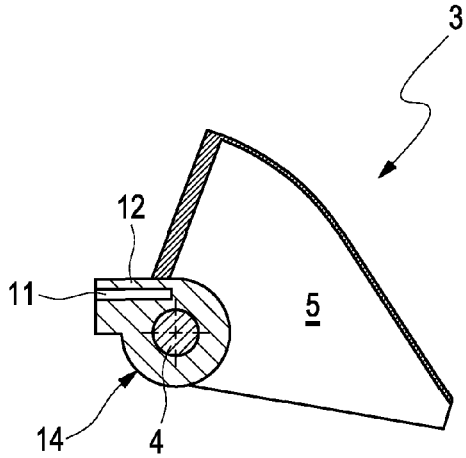

FIGS. 3*a* and 3*b* show rough schematic examples of possible geometrical designs of the leaf spring 7 which for example can be formed as a flat metal strip. Such a leaf spring 7 comprises a first end portion 8 for supporting on the housing 2 of the fresh air system 1 and a second end portion 9 for supporting on the pivot shaft 4.

In the example of FIG. 3*a*, the first end portion 8 of the leaf spring 7 is designed curved. Such a quality of the leaf spring allows keeping the installation space required for installing the leaf spring 7 in the housing 2 of the fresh air system 1 relatively small. A curved design of the leaf spring 7 however is not limited to its first end portion 8 only: in the example of FIG. 3*b* for example the entire leaf spring 7 except for the second end portion 9 is designed curved.

In order to now keep the installation space required for fastening the leaf spring 7 on the housing as small as possible it is advisable to form a support region 10 designed pocket-like on the housing 2, which is schematically shown in the FIGS. 1*a*/1*b*. On the housing walls of such a pocket the first end portion 8 of the leaf spring 7 can then support itself.

Mechanically stable fastening of the preload element 8 formed as a leaf spring 7 in the exemplary scenario can—also in the event that another spring 5, for example an already mentioned coil spring is used—be achieved in that on the pivot shaft 4 a holding element 14 is provided, in which the recess 11 is arranged. As shown in the figures, the holding element 14 can be designed as a separate component and be fastened to the pivot shaft 4 in a rotationally fixed manner. Alternatively to this however it is also conceivable to integrally mould the holding element 14 on the pivot shaft 4 (not shown). In a further version the recess 11 can also be provided directly on the pivot shaft 4 (not shown).

In a further version of the example, which in FIG. 2 is exemplarily shown only for a single flap 5 in dashed representation for the sake of clarity, the preload element 6, for example in the form of the already mentioned leaf spring 7, can also support itself on the flap 5. For this purpose, a recess 11 which was already discussed above in connection with the pivot shaft 4 can also be provided on the flap 5. Analogously to the above example, the recess 11 can be directly provided in the flap 5 or as shown in dashed representation in FIG. 2 be provided in a holding element 14, which is explained above in connection with the pivot shaft 4 and shown in the FIGS. 1*a* and 1*b*. If the recess 11—be it directly or indirectly in said holding element 14—is provided in the flap 5, it proves to be advantageous to arrange the recess in the region of the flap 5 in which the same or the pivot shaft 4 is mounted on the housing 2. This region is exemplarily marked in FIG. 2 for a single flap 5 with the reference number 15.

In all cases, the second end portion 9 of the leaf spring 7 can be inserted in the recess 11 for supporting on the pivot shaft 4 or on the flap 5. In order to be able to provide the recess 11 with a particularly large recess depth for the stable fixing of the leaf spring 7, an extension 12 is provided on the holding element 14 of substantially hollow-cylindrical form, in which in turn said recess 11 is arranged.

Figure 5:
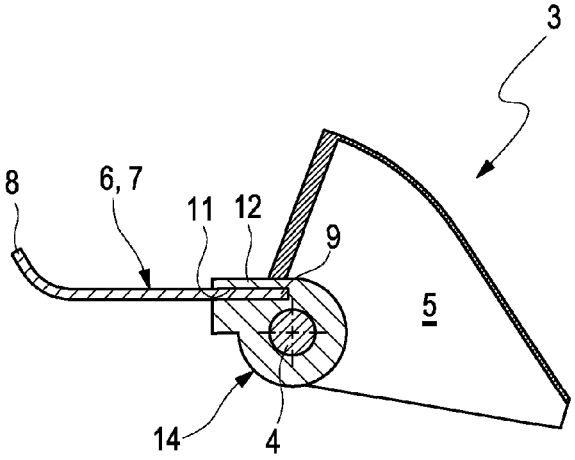

For illustration, FIG. 5 shows the flap mechanism 3 with leaf spring 7 inserted in the recess 11. For durably fixing the leaf spring 7 in the recess 11 the person skilled in the art has a plurality of options, conceivable for example are fastening by means of screwing, clipping or injection overmoulding. Simple inserting of the second end portion 9 into the recess 11 is also easily conceivable.

Figure 6:
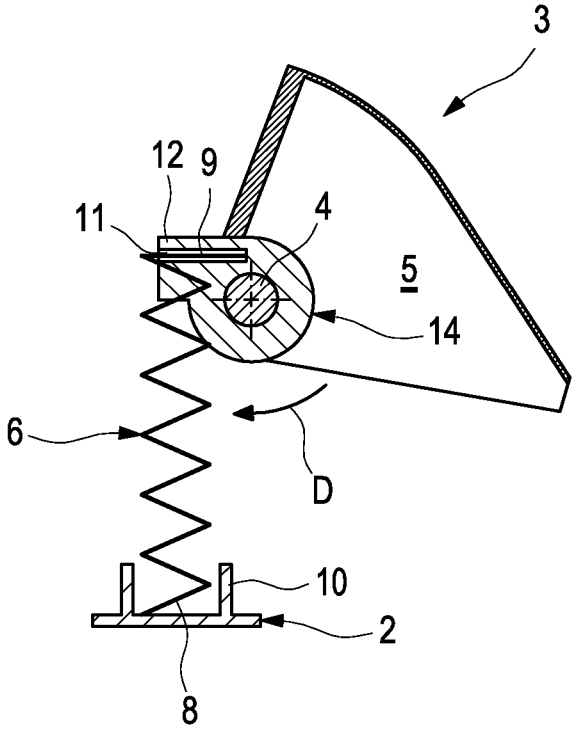
Figure 7:
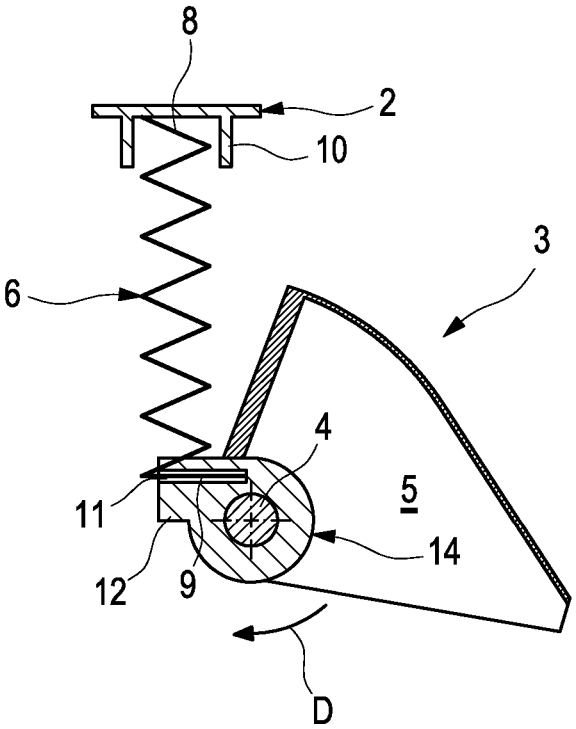

Depending on the manner in which the preload element 6 is arranged between pivot shaft 4 and housing 2 a tension spring arrangement (schematically shown in FIG. 6) or compression spring arrangement (schematically shown in FIG. 7) can prove to be as a particularly advantageous form of realisation in terms of design. In the case of the tension spring arrangement shown in FIG. 6 the preload element 6 is subjected to tensile loading starting out from a starting position shown in FIG. 6 by rotating the pivot shaft 4 or the flap 5 in the direction of rotation D and transferred into a state which is elongated with respect to the starting position. In the case of the compression spring arrangement shown in FIG. 7, a pivot movement of the pivot shaft 4 in pivot direction D by contrast results in a compression of the preload element 6, so that the same is subjected to compression loading. In both cases, the preload force generated by the preload element 6 and acting on the pivot shaft 4 or the flap 5 is increased. Depending on the installation situation in the fresh air system 1, realisation as tension or compression spring arrangement can prove to be advantageous.

For the control movement of the pivot shaft 4 and the at least one flap 5 attached thereon the flap mechanism 3 is preferably equipped with an in particular electrically driven actuator that is drive-connected to the pivot shaft 4, which actuator is roughly schematically shown in FIG. 2 and marked with the reference number 13.

The invention claimed is:

1. A fresh air system for supplying combustion chambers of an internal combustion engine with fresh air, comprising:

a housing, through which at least one fresh air path passes;

a flap mechanism including at least one flap and a pivot shaft rotationally adjustably mounted on the housing, the at least one flap being rotatably adjustable between a closed position, in which the at least one flap closes off the fresh air path in a fluid-tight manner and an opened position, in which the at least one flap opens the fresh air path for fresh air to flow through; and a recess provided on at least one of the pivot shaft and the at least one flap, the recess disposed in a fixed location relative to the at least one of the pivot shaft and the at least one flap;

wherein the flap mechanism includes a spring-elastic preload element, the spring-elastic preload element having a first end portion supported on the housing and a second end portion arranged to preload the at least one flap against the opened position or the closed position, and wherein the second end portion is received in the recess.

2. The fresh air system according to claim 1, wherein at least two fresh air paths are provided and the flap mechanism includes at least two flaps associated with a corresponding one of the at least two fresh air paths, in each of which a flap is provided, and wherein the at least two flaps are each attached to the pivot shaft in a rotationally fixed manner.

3. The fresh air system according to claim 1, wherein the spring-elastic preload element is a leaf spring or a coil spring.

4. The fresh air system according to claim 1, wherein the housing includes a pocket-like support region, the pocket-like support region supporting the first end portion of the spring-elastic preload element.

5. The fresh air system according to claim 1, wherein the spring-elastic preload element is arranged between the housing and the at least one of the pivot shaft and the at least one flap such that the spring-elastic preload element acts as a tension spring and a compression spring.

6. The fresh air system according to claim 1, further comprising a holding element arranged rotationally fixed on at least one of the pivot shaft and the at least one flap, the holding element having a substantially hollow-cylindrical structure and including an extension projecting radially with respect to the pivot shaft, wherein the recess receiving the second end portion of the spring-elastic preload element is arranged on the extension.

7. The fresh air system according to claim 1, wherein:

the preload element is formed as a leaf spring, and at least the first end portion of the leaf spring is curved.

8. The fresh air system according to claim 1, wherein the flap mechanism further includes an electrically driven actuator arranged drive-connected with the pivot shaft, and wherein the at least one flap via the actuator is pivot-adjustable between the opened position and the closed position.

9. An internal combustion engine, comprising:

at least one combustion chamber, a fresh air system fluidically connected to the combustion chamber, the fresh air system including:

a housing through which at least one fresh air path passes; and a flap mechanism including at least one flap rotation-adjustably mounted on the housing via a pivot shaft, a recess disposed on at least one of the pivot shaft and the at least one flap, the at least one flap being rotatably adjustable between (i) a closed position, in which the at least one flap closes off the fresh air path in a fluid-tight manner, and (ii) an open position, in which the at least one flap opens the fresh air path for fresh air to flow through;

wherein the flap mechanism includes a spring-elastic preload element structured as a leaf spring or a coil spring, the spring-elastic preload element supporting itself on the housing and preloads the flap against at least one of the opened position and the closed position;

wherein the spring-elastic preload element includes a first end portion supported on the housing and a second end portion supported in the recess disposed on the at least one of the pivot shaft and the at least one flap for preloading the at least one flap.

10. The internal combustion engine according to claim 9, wherein at least four fresh air paths are provided and each path includes an associated flap, and wherein the respective flaps are attached to the pivot shaft.

11. The internal combustion engine according to claim 9, wherein the housing includes a pocket-shaped support region for supporting the first end portion of the preload element.

12. The internal combustion engine according to claim 9, wherein the preload element is arranged between the housing and at least one of the pivot shaft and the at least one flap such that the preload element acts as a tension spring and a compression spring.

13. The internal combustion engine according to claim 9, wherein the preload element is structured as the coil spring and the first end portion is arranged opposite to the second end portion.

14. The internal combustion engine according to claim 13, wherein the preload element is formed as a leaf spring, and wherein at least the first end portion is curved.

15. The internal combustion engine according to claim 9, further comprising a holding element coupled to at least one of the pivot shaft and the at least one flap, wherein the holding element includes a radially projecting extension and the recess is arranged in the extension, wherein the second end portion of the preload element is received in the recess.

16. The internal combustion engine according to claim 9, wherein the flap mechanism includes an electrical actuator drive-connected with the pivot shaft, wherein the actuator pivotally adjust the at least one flap between the opened position and the closed position.

17. A fresh air system for supplying fresh air to an internal combustion engine, comprising:

a housing through which at least one fresh air path extends;

a flap mechanism including at least one flap rotation-adjustably mounted on the housing via a pivot shaft, the at least one flap being rotatably adjustable between (i) a closed position, in which the at least one flap closes off the fresh air path in a fluid-tight manner, and (ii) an open position, in which the at least one flap opens the fresh air path for fresh air to flow through;

a holding element coupled to at least one of the pivot shaft and the at least one flap, the holding element having a hollow-cylindrical structure and including a radially projecting extension, the extension provided with a recess; and an electrical actuator drive-connected with the pivot shaft to pivotally adjust the at least one flap between the opened position and the closed position;

wherein the flap mechanism includes a spring-elastic preload element to preload the at least one flap against one of the open position and the closed position, the spring-elastic preload element having a first end portion supported on the housing and a second end portion received within the recess arranged in the extension.

18. The fresh air system according to claim 17, wherein the housing includes a pocket-shaped support region, and wherein the first end portion of the spring-elastic preload element is arranged in the pocket-shaped support region of the housing.

* * * * *